US005406580A

United States Patent [19]

McCaffrey

[11] Patent Number: 5,406,580

[45] Date of Patent: Apr. 11, 1995

[54] ELECTRODE SEAL FOR ARC FURNACES

[75] Inventor: Felim P. McCaffrey, Toronto, Canada

[73] Assignee: Hatch Associates Ltd., Mississauga, Canada

[21] Appl. No.: 172,160

[22] Filed: Dec. 23, 1993

[51] Int. Cl.[6] ..... H05B 7/12

[52] U.S. Cl. ..... 373/95; 373/94

[58] Field of Search ..... 373/94, 95, 96, 52, 373/51; 277/12, 16, 30

[56] References Cited

U.S. PATENT DOCUMENTS

| | | | |
|---|---|---|---|
| 1,690,795 | 11/1928 | Sagramoso | 373/96 |
| 1,732,431 | 10/1929 | Bruggmann | 373/95 |
| 2,979,550 | 4/1961 | Sherman | 373/95 |
| 3,683,095 | 8/1972 | Salmin et al. | 373/95 |
| 3,697,660 | 10/1972 | Frolov et al. | 373/95 |
| 3,709,506 | 1/1973 | Beerman | 373/95 |
| 3,835,233 | 9/1974 | Prenn | 373/95 |
| 4,027,095 | 5/1977 | Kishida et al. | 373/95 |
| 4,295,001 | 10/1981 | Britton | 373/95 |
| 4,306,726 | 12/1981 | Lefebvre | 373/95 |
| 4,347,400 | 8/1982 | Lamarque | 373/77 |
| 4,442,526 | 4/1984 | Rappinger et al. | 373/95 |
| 4,457,002 | 6/1984 | Mathgen et al. | 373/95 |
| 4,759,032 | 7/1988 | Willis | 373/95 |

OTHER PUBLICATIONS

"Preventing EAF Fume and Dust Escape", Cywinski, Steel Times International, Nov. 1992.

*Primary Examiner*—Bruce A. Reynolds
*Assistant Examiner*—Tu Hoang
*Attorney, Agent, or Firm*—Ridout & Maybee

[57] ABSTRACT

An electrode seal for arc furnaces, particularly arc furnaces for steel making, has a first element in the form of a water cooled copper sleeve lining an aperture in the furnace roof for passage of an electrode, the sleeve having an upper surface engaged by a lower surface of a horizontally slidable seal ring formed by beryllium copper water cooled segments which abut end-to-end to form a close fitting collar around the electrode having an internal diameter the same as the external diameter of the electrode. The segments are spring loaded radially against each other and so as to center them over the aperture, so as to accommodate any minor oversize or irregularities of the electrode, as well as damping horizontal movement of the latter, and are also spring-urged downwardly against the sleeve. Water passages in the segments and in the sleeve are connected in series, and water piping and spring loading apparatus are arranged to leave part of the periphery of the seal free, allowing close grouping of electrodes.

12 Claims, 4 Drawing Sheets

ELECTRODE SEAL FOR ARC FURNACES

BACKGROUND OF THE INVENTION

1. Field of the Invention

This invention relates to electrode sealing arrangements for electric arc furnaces.

2. Review of the Art

Electric arc furnaces usually comprise a crucible and generally vertical carbon electrodes supported so as to depend into the crucible. In order to contain fumes, maintain a desired atmosphere within the furnace and control heat loss, it is common practice to provide such furnace with a lid or roof having apertures through which the electrodes depend. In furnaces where it is necessary to open the lid or roof, it is necessary to withdraw the electrodes, which will be extremely hot at their lower ends. Depending on the type and usage of the furnace, a greater or lesser amount of vertical electrode movement must be accommodated during normal operation of the furnace, and electrodes must also be advanced downwardly to compensate for consumption of the electrode tips. Additionally, and particularly during the initial stages of melting a charge, current surges through the electrodes apply very substantial electromagnetic forces to them, which can cause significant lateral deflection. These and other factors place extremely severe requirements upon arrangements designed to provide a seal between the electrodes and roof of an electric furnace.

Where only a moderate range of electrode movement needs to be accommodated, water cooled telescoping seals may be utilized, as exemplified by those described in French Patent No. 1,418,153 (IRSID), U.S. Pat. No. 4,306,726 (Lefebvre) and U.S. Pat. No. 4,027,095 (Kishida et al).

U.S. Pat. No. 4,745,619 (Strobele) discloses an electrode seal structure in which a water cooled sleeve is provided around that portion of the electrode extending through the roof during normal operation of the furnace, supporting or providing a seal element which interacts with a further annular sealing element retained around the associated aperture in the furnace roof such that the electrode mounted sealing element may be lifted clear of the sealing element retained on the furnace roof when electrodes are withdrawn from the furnace to permit opening of the roof. In such an arrangement, the water cooled sleeve complicates the electrode structure, and even if carefully designed may be vulnerable in some cases to damage by arcing within the furnace when at the lower end of its range of movement. Other seal structures utilizing water cooled sleeves surrounding and carried with the electrodes have been proposed in U.S. Pat. No. 1,690,795 (Sagramoso) and U.S. Pat. No. 4,347,400 (Lamarque).

Proposals have also been made for electrode seal structures which are supported by the furnace roof and act directly upon the surface of the electrode in sliding contact with it. U.S. Pat. No. 4,457,002 utilizes a water cooled sleeve depending into the furnace, but supported from the furnace roof. Such an arrangement has many of the same disadvantages as arrangements using a sleeve attached to the electrode, requires a multi-segmental shield ring below the sleeve, and provides only limited clearance to accommodate lateral movement of the electrode. It does not appear suitable for applications in which the electrodes must be frequently withdrawn through the roof of the furnace, as for example in furnaces for melting scrap steel.

U.S. Pat. No. 4,442,526 (Rappinger) discloses an electrode seal for use in conjunction with a furnace having a conductive water cooled roof. Very little detail is provided of the structure Of the seal itself, and the entire arrangement appears predicated upon the use of a water cooled roof.

U.S. Pat. No. 3,838,233 (Prenn) discloses a system for supporting the weight of seal assemblies independently of a furnace roof, whilst permitting accommodation of lateral movement of the electrodes. The seals themselves are rings of refractory materials, possibly supplemental by pivoted segmented seals. If such pivoted seals are used, it is not apparent how adequate electrical isolation is maintained between the electrodes.

U.S. Pat. No. 4,295,001 (Britton) and U.S. Pat. No. 4,759,032 (Willis) both disclose arrangements in which a large number of refractory seal segments are pressed inwardly against the electrode or each electrode so as to maintain a desired seal.

U.S. Pat. No. 2,979,550 (Sherman) discloses an arrangement in which a large number of pivoted, segmented, water cooled seal segments are pressed inwardly by gravity and spring action against an electrode, a supplementary diaphragm seal being provided between the segments and a support ring.

In practice, none of the above systems has proved generally acceptable to operators of arc furnaces used for the melting of steel. One solution that has been proposed is a form of gas seal, in which compressed air is blown into the gaps between the electrodes and the furnace roof, as described in an article "Preventing EAF Fume and Dust Escape" by Mark Cywinski, Steel Times International, November 1992. This solution of itself represents a tacit acknowledgment that satisfactory electrode seal arrangement is not generally available for use in steel melting applications.

An object of the present invention is to provide an electrode seal for electric arc furnaces which is effective, of relatively simple and economical construction, which can be made sufficiently light to be safely supported on a refractory furnace roof, which is compatible with repeated complete withdrawal of the electrodes from the furnace, and which can help extend the life of the refractory roof.

Rather than trying to force seal elements against the surface of an electrode so as to maintain a seal, which tends to result in excessive wear on the seal elements and may incur the risk of jamming, I form a sealing ring in a relatively small number of water cooled metallic segments, resiliently urged into circumferential end-to-end abutment so as to form a close-fitting girdle around the electrode having an internal diameter which closely matches the nominal external diameter of the electrode. Electrode manufacturers specify the outside diameter of carbon electrodes within comparatively narrow tolerances, but in practice much closer tolerances are normally maintained. By setting the internal diameter of the sealing ring in a suitable relationship to this narrower range of tolerance, a good fit can be maintained, whilst excessive wear or frictional engagement is avoided because inward movement of the seal segments is limited by their end-to-end abutment. Present indications are that an internal diameter near the upper end of the range of diameters within which electrode diameters normally fall will provide the best results, but experience may suggest some upward or downward adjustment of this relationship. The objective is to provide an arrangement in which the ring segments will normally abut or very nearly abut, and separation of the segments will normally be needed only to accommodate adherents to the surface of the electrode and irregularities at joints between electrode segments. Any displacement against the resilient bias which is needed to accommodate the electrode itself will be very small indeed. The sealing ring is resiliently pressed downwards so as to form a planar annular seal with a planar surface on a further seal component which also provides a cylindrical water cooled liner for the aperture in the furnace roof through which the electrode passes. This further seal component not only completes the seal whilst allowing for lateral movement of the electrode, but also anchors the assembly to the roof and protects the inside surface of the aperture against the thermal stresses to which it would otherwise be subject.

Further features of the invention will be apparent from the following description of a presently preferred embodiment and from the appended claims.

SHORT DESCRIPTION OF THE DRAWINGS

DESCRIPTION OF THE PREFERRED EMBODIMENT

Figure 1:
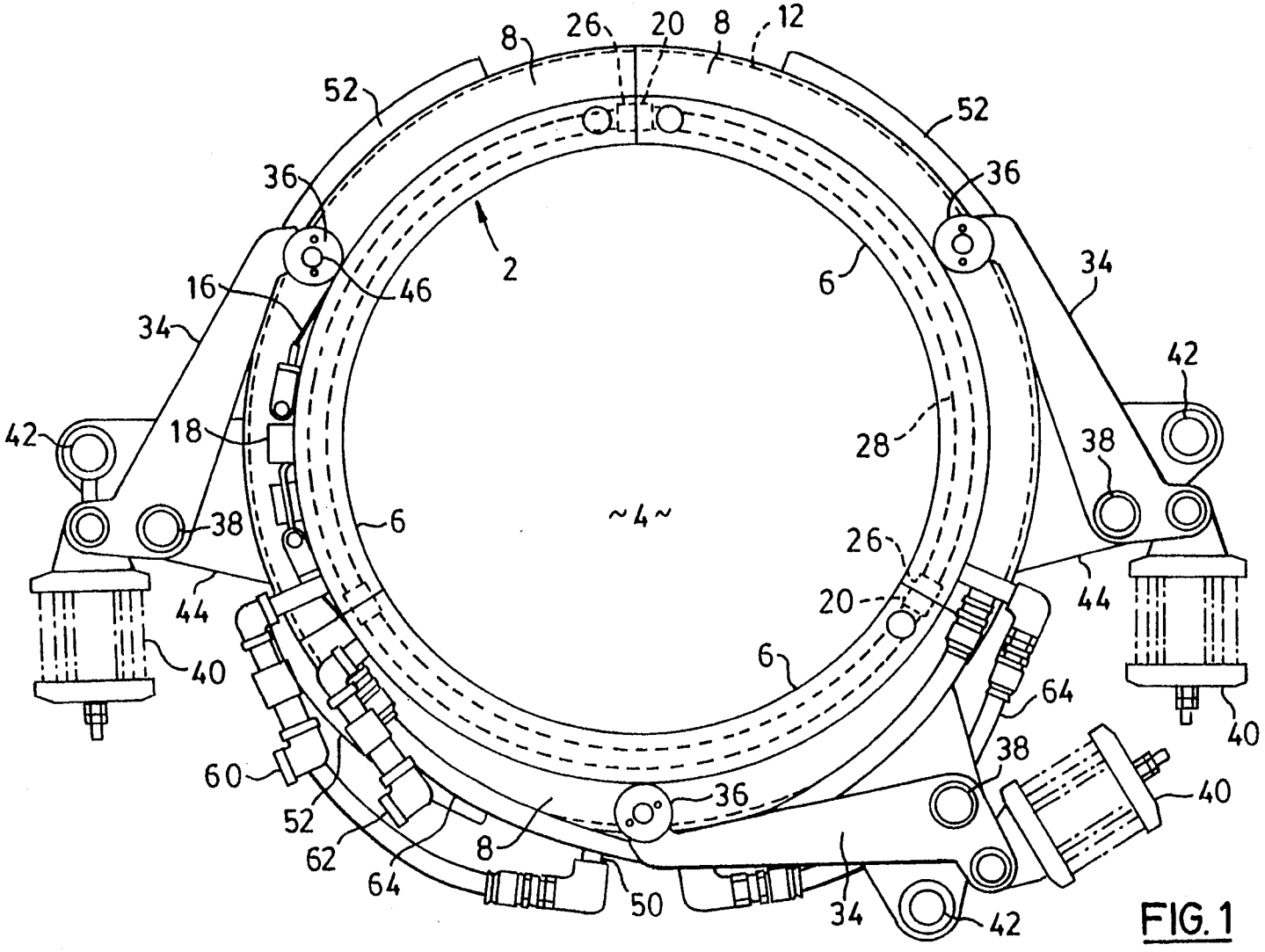
FIG. 1 is a plan view of one embodiment of electrode seal assembly according to the invention.
Figure 2:
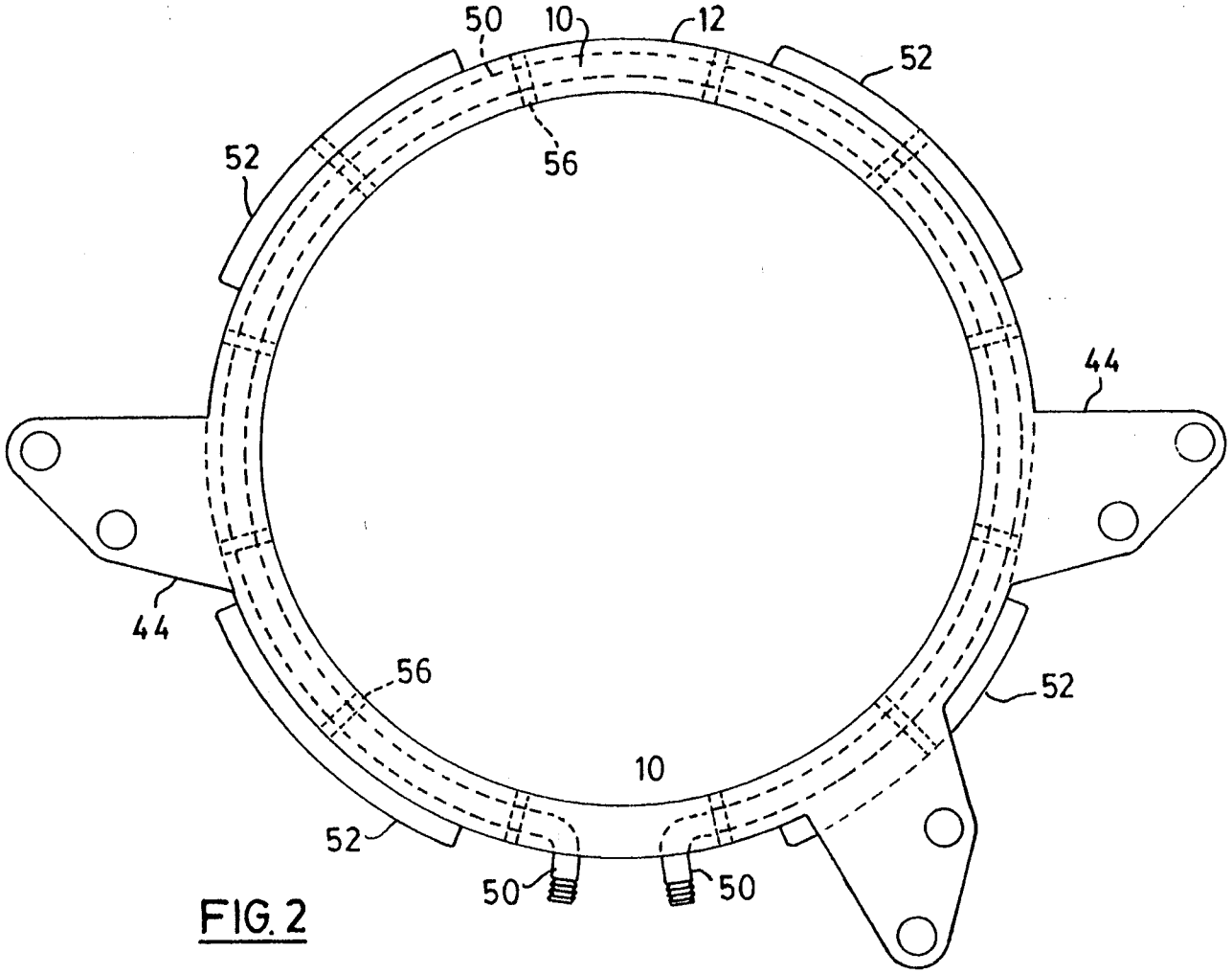
FIG. 2 is a vertical section on the line A—A in FIG. 1, showing adjacent portions of an electrode and a furnace roof.

While the following description is particularly directed to an embodiment of the invention intended for use in a three phase alternating current electric steel making furnace having three electrodes spaced in a triangle, it should be understood that the invention is also applicable to other alternating and direct current arc furnaces having one or more electrodes. It is however an advantage of the invention, as best seen in FIG. 1, that the seal mechanism can be physically arranged to leave unobstructed that part of the furnace roof between the electrodes which can then easily be kept clean, with the assistance of air jets or otherwise, to minimize the risk of arcing between the electrodes due to the build up of electrically conductive deposits and the presence of electrically conductive structure.

Referring to the drawings, the electrode seal consists of two main interacting elements. A first element, in the form of a cylinder 12, lines an aperture in a furnace roof 14. A second element is in the form of a ring 2 contacting an electrode 4, formed in three segments 6, each having a base plate 8, the base plates 8 cooperating to provide a lower planar annular surface which rests on an upper annular planar surface 10 of the cylinder 12. The base plates 8 can move laterally over the surface 10 to accommodate lateral movement of the electrodes relative to the furnace roof.

Figure 5:
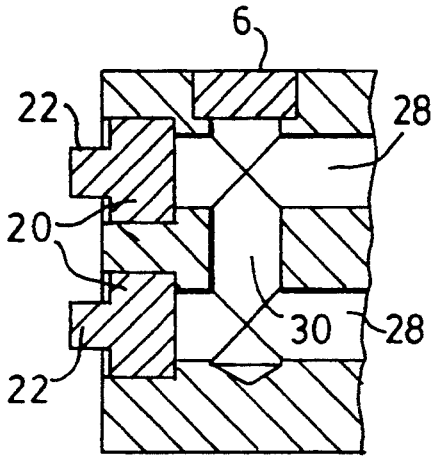
FIGS. 5 and 6 are fragmentary vertical circumferential sections through opposite ends of a segment forming part of a second main element of the assembly.
Figure 6:
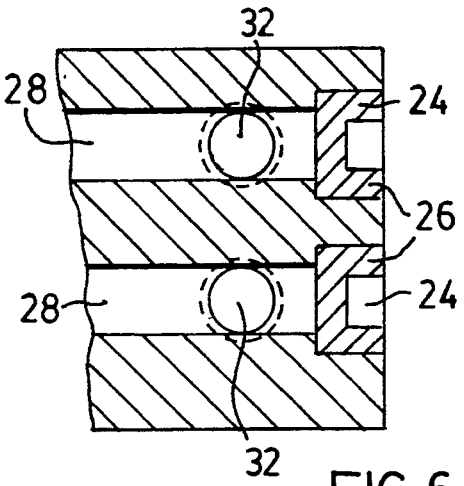
Figure 4:
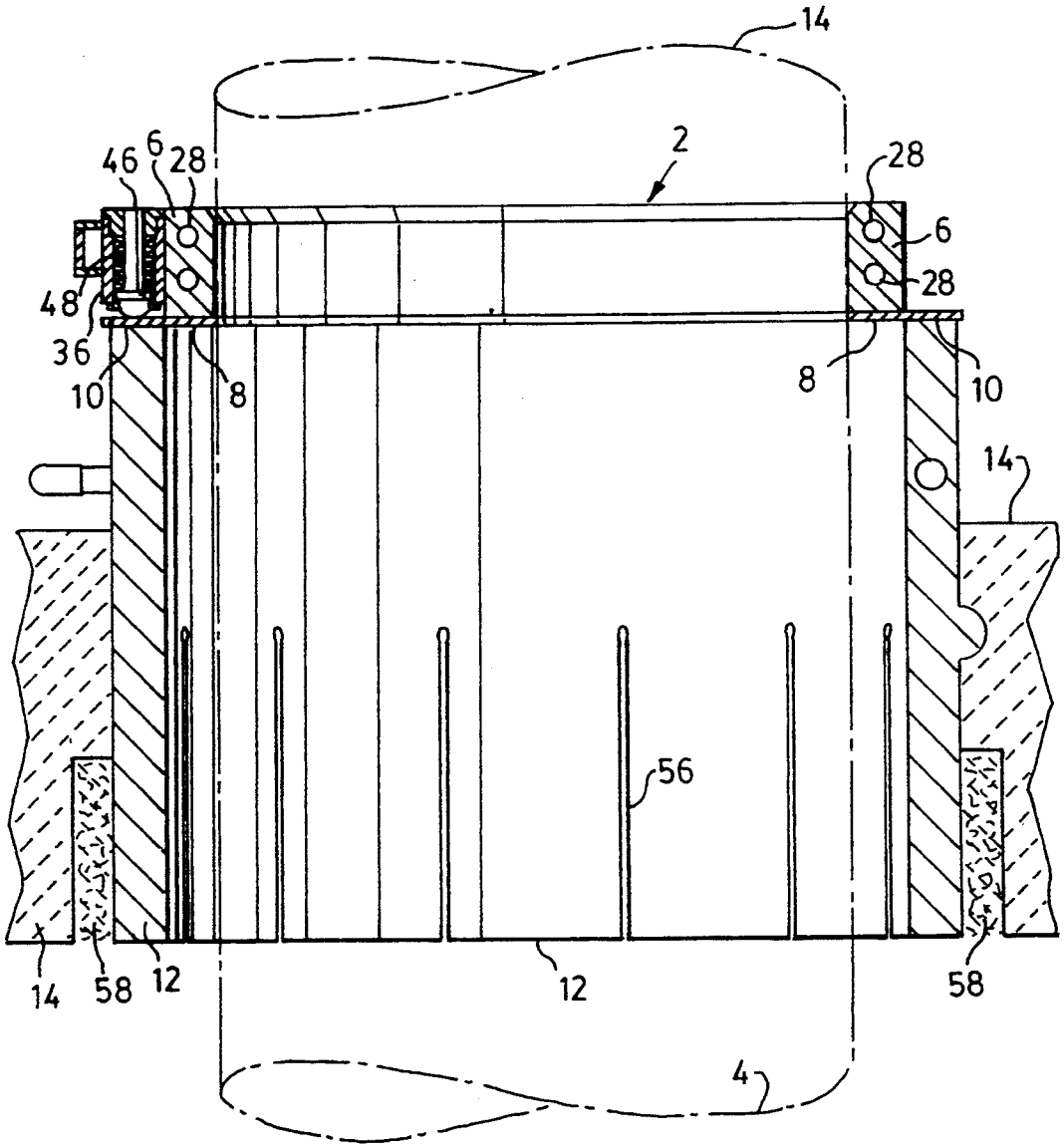
FIG. 4 is a plan view of a first main element of the seal assembly.

The segments 6 are resiliently held in abutment by a girdle cable 16 whose ends are connected by a tension spring assembly 18, and in alignment and against tipping by plugs 20 having tapered spigots 22 entering sockets 24 in plugs 26 (see FIGS. 5 and 6). The abutting and inside faces of the segments are machined so as to provide when abutted an internal diameter of the ring 2 which will closely embrace the electrode; it presently appears that a diameter at an upper end of a narrow range of diameters presented by the vast majority of electrode segments of a given nominal diameter is approximate. Thus 95% of nominal 24 inch diameter electrodes from Union Carbide are found to have diameters in the range 24.06 to 24.09 inches, with the remaining electrodes being of slightly less than 24.06 inches diameter, although the manufacturer's quoted tolerance is substantially greater (23.875 to 24.125 inches). For such electrodes, a ring internal diameter of 24.09 inches is believed optimum, although a diameter anywhere in the quoted range is probably satisfactory. Shims between segments may be used to adjust diameter if necessary. The objective is to minimize conditions under which excessive gaps (greater than about 0.03 inches) occur either between adjacent segments or between the segments and the electrode.

Figure 3:
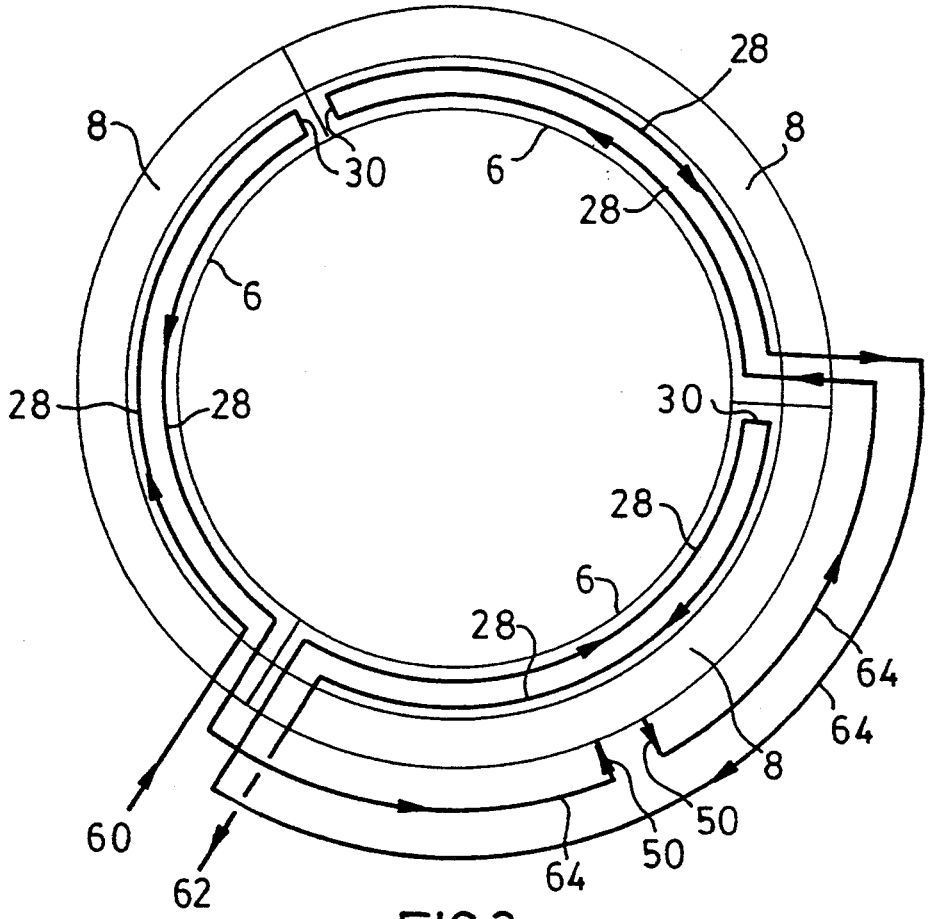
FIG. 3 is a diagram illustrating water flow through the seal assembly.

The segments 6 are formed by preparing beryllium copper bars with parallel longitudinal bores and bending the bars to form 120° segments with longitudinal cooling channels 28 which are then closed at their ends by the plugs 20 and 26. The channels 28 are connected near their one ends by an externally plugged cross-bore 30, and at their other ends by threaded radial bores to external pipe connections as shown in FIG. 3. The base plates 8 are formed of stainless steel and bolted to the beryllium copper segments. Whilst beryllium copper and stainless steel are preferred materials, other non-ferromagnetic metals or alloys could be utilized if adequate heat conductivity and wear resistance properties can be achieved.

The segments 6 are further biased into abutment and the resulting ring 2 is biased into alignment with the cylinder 12 by horizontal forces applied through shoes 36 on levers 34, fulcrumed on pivots 38 capable of sustaining vertical thrust and driven by both spring assemblies 40 whose reaction is sustained by pivots 42. The pivots 38 and 42 are supported by flanges 44 projecting outwardly from the top of the cylinder 12. The shoes 36 contain plungers 46 which are spring biased downwardly by a stack of disc springs 48 so as to force the base plates 8 downwardly into contact with the surface 10 of the cylinder 12.

The cylinder 12, which has an internal diameter which may be about 15%–20% larger than that of the electrode so as to provide adequate clearance for lateral electrode movement, may be cast from copper, a circumferential pipe 50 for cooling being cast in. The cylinder is provided with external ribs 52 to retain it in the furnace roof, which is cast around it from a refractory cement composition suited to the application, such as high alumina or chrome cement. In order to reduce thermal shock effect when electrodes are withdrawn through the cylinder 12, a gap may be left between the lower portion of the cylinder and the furnace roof composition which is packed with refractory fibre 58, or lower portion is also formed as shown with vertical slots 56 to accommodate differential expansion of the copper and the refractory.

The pipe 50 is connected by external pipework 64 in series with the cooling channels 28 in the segments 6 so that single inlet and outlet connections 60 and 62 may be utilized for the entire seal, and no external water piping is required on that side of the seal (the top side in FIG.

1) nearest the other electrodes. Serial connection of the water passages has the advantage that any obstruction can be immediately detected, while obstruction of one of several parallel connected passages may not be immediately apparent. The levers 34 are oriented so as to leave that same side of the seal unobstructed. This enables multiple electrodes to be grouped desirably close together, since the space between the electrodes to be kept clear of obstructions which reduce clearances or promote build up of conductive deposits which could in conjunction with ionized gases escaping through the seal prompt unwanted arcing between electrodes.

In use, the ring 2 closely embraces the electrode 4 and is held in sealing contact with the cylinder 12 by the springs 48. The girdle cable 16 and cylinder 40 tend to maintain the segments 6 in abutment, but permit slight outward movement to allow for oversize electrode segments, slight misalignment between abutting electrode sections, and spattered material adhering to the electrode surface. The close sizing should however help minimize wear on both the ring and the electrode since the retention forces applied to the seal segments are normally sustained by the abutting ends of the segments rather than the sealing surfaces of the ring and the electrode. Better accommodation of electrode tolerances may be achieved by relieving the inner surfaces of the segments adjacent their ends by a few thousandths of an inch during manufacture. The frictional engagement between the abutting horizontal surfaces of the plates 8, and the surface 10 accommodates, but applies substantial damping to horizontal movement of the electrode relative to the furnace roof, whilst the resilient vertical loading applied by the springs 48 allows a small measure of vertical movement of the seal during vertical movement of the electrode which helps break any momentary jamming.

The cylinder 12 helps protect the furnace roof around the aperture against the erosion which takes place in the absence of an effective electrode seal, and also protects the refractory material against the severe temperature transients that occur when the white hot tip of an electrode is withdrawn through the aperture, whilst the construction of the lower end of the cylinder helps prevent stressing of the refractory due to differential thermal expansion of the cylinder and the roof. The simple construction of the seal and its water passages means that it is not unduly massive and therefore does not apply to excessive loads to the roof. It may be tethered to avoid any risk of it falling into the furnace in the event of roof collapse.

I claim:

1. An electrode seal for closing a clearance between an aperture in a roof of an electric arc furnace and an electrode passing through the aperture, comprising: a first seal element retained in the furnace roof around the periphery of the aperture, said first seal element being formed by a tubular cylindrical member lining the aperture and having an internal diameter substantially greater than an external diameter of the electrode, said cylindrical member defining an upper planar annular surface surrounding the aperture; a second annular seal element having a lover planar annular surface resting on the upper planar annular surface of the first seal element, the second seal element being formed in plural independently movable circumferential segments abutting end-to-end to define a girdle around the electrode with an inner surface having a diameter small enough to be a close fit around the electrode, such that gaps between the electrode and the second seal element are less than about 0.03 inches, yet large enough to be normally controlled by said abutting end-to-end of the segments; radially acting resilient retaining devices engaging said second seal element to urge said segments into abutting relationship, said retaining devices including devices supported by said first element and acting to center the second seal element over the aperture; and further resilient retaining devices supported from said first seal element and acting to urge the lower planar annular surface of said second seal element into engagement with the upper planar annular surface of said first seal element.

2. An electrode seal according to claim 1, wherein both seal elements are formed of non-ferromagnetic metal, and have passages for cooling water formed therein.

3. An electrode seal according to claim 2, wherein cooling passages in the first seal element and each segment of the second seal element are connected in series.

4. An electrode seal according to claim 2, wherein the first seal element is of copper, and the segments of the second seal element are of beryllium copper.

5. An electrode seal according to claim 4, wherein the segments have wear plates of stainless steel defining said lower planar annular surface.

6. An electrode seal according to claim 1, wherein said radially acting resilient retaining devices include levers fulcrumed on the first seal element and acting on each segment, and springs supported by the first seal element and acting to urge the levers radially against the segments.

7. An electrode seal according to claim 6, wherein said radially acting resilient retaining devices further include a resiliently loaded girdle around the segments.

8. An electrode seal according to claim 6, wherein portions of said levers engaging the segments include said further resilient retaining devices in the form of spring load plungers urges said lower planar annular surface of said second seal element downwardly into contact with the upper planar annular surface of the first seal element.

9. An electrode seal according to claim 1, for use in a furnace having a triangular group of three electrodes, wherein said resilient retaining devices are located so as to leave a peripheral portion of the electrode seal, which is oriented to face other electrodes in the group, free from projections formed by said retaining devices.

10. An electrode seal according to claim 9, wherein cooling passages are connected by external pipes arranged to leave said peripheral portion of the electrode seal free of said pipes.

11. An electrode seal according to claim 1, wherein a lower portion of the tubular cylindrical member is formed with peripherally spaced vertical slots.

12. An electrode seal according to claim 1, wherein a lower portion of the tubular cylindrical member is surrounded with fibrous packing within the aperture in which it is installed.

* * * * *